US005091830A

United States Patent [19]

Suzuki

[11] Patent Number: 5,091,830

[45] Date of Patent: Feb. 25, 1992

[54] PROJECTION TYPE VEHICULAR HEADLAMP

[75] Inventor: Yoshinobu Suzuki, Shizuoka, Japan

[73] Assignee: Koito Manufacturing Co., Ltd., Tokyo, Japan

[21] Appl. No.: 713,201

[22] Filed: Jun. 11, 1991

[30] Foreign Application Priority Data

Jun. 19, 1990 [JP] Japan ..... 2-158621

[51] Int. Cl.[5] ..... F21M 3/14

[52] U.S. Cl. ..... 362/61; 362/794; 362/351

[58] Field of Search ..... 362/61, 80, 294, 351, 362/373

[56] References Cited

U.S. PATENT DOCUMENTS

| | | | |
|---|---|---|---|
| 4,677,532 | 6/1987 | Peitz et al. . | |
| 4,686,610 | 8/1987 | Cibie et al. . | |
| 4,727,458 | 2/1988 | Droste et al. | 362/61 |
| 4,797,790 | 1/1989 | Brodling et al. . | |
| 4,800,467 | 1/1989 | Lindae et al. | 362/61 |
| 4,862,329 | 8/1989 | Nino | 362/61 |
| 4,914,747 | 4/1990 | Nino | 362/61 |
| 4,922,386 | 5/1990 | Bockeler et al. | 362/61 |
| 4,967,319 | 10/1990 | Seko | 362/61 |

FOREIGN PATENT DOCUMENTS 1277219 7/1968 United Kingdom .

*Primary Examiner*—Ira S. Lazarus
*Assistant Examiner*—Cole: Richard R.
*Attorney, Agent, or Firm*—Sughrue, Mion, Zinn, Macpeak & Seas

[57] ABSTRACT

A projection type vehicular headlamp having a projection unit including a reflector accommodating therein a light source, a tubular lens holder engaged with the front opening of the reflector, and a projection lens supported by the lens holder as one unit, with a clear cut forming shade provided inside the lens holder in such a manner that the shade blocks substantially the lower half of the section of the optical path in the projection unit. In the vehicular headlamp, the shade has an opening in the lower end portion thereof through which spaces fore and rear sides of the shade are communicated with each other.

9 Claims, 2 Drawing Sheets

PROJECTION TYPE VEHICULAR HEADLAMP

BACKGROUND OF THE INVENTION

1. Field of the invention

The present invention relates to a headlamp for an automobile, motor cycle and motor-driven bicycle (hereinafter referred to merely as "a vehicle", when applicable), and more particularly to a projection type vehicular headlamp in which light beam emitted from a light source is reflected by a reflector, and the light beam thus reflected is irradiated through a projection lens. The projection type vehicular headlamp has been known as disclosed, for example, in U.S. Pat. Nos. 4,677,532 or 4,797,790.

2. Related art

A conventional headlamp of this type is schematically constructed as shown in FIG. 1. The light beam emitted from a light source, namely, a light bulb 2 is reflected by a reflector 3, and the light beam thus reflected is irradiated through a projection lens 4. The reflector 3 accommodating therein the light bulb 2 is unitary engaged with a lens holder 5 holding the lens 4, thus forming a projection unit 1. A clear cut forming shade 6 is provided in the lens holder 5.

The conventional headlamp described above suffers from following difficulties: The shade 6 is extended like an upright wall which blocks substantially the lower half of the section of the optical path in the lens holder 5; that is, the shade 6 disadvantageously suppresses heat convection in the projection unit 1. Hence, the heat generated by the light bulb 2 is caught behind the shade (indicated at A in FIG. 1), thus adversely affecting the radiation of heat of the projection unit 1, the lighting characteristics of the light bulb 2 acting as the light source, or a lamp body 7 surrounding the projection unit 1.

SUMMARY OF THE INVENTION

Accordingly, an object of the invention is to eliminate the above-described difficulties accompanying a conventional headlamp. More specifically, an object of the present invention is to provide a projection type vehicular headlamp having a clear cut forming shade capable of allowing a heat convection in the projection lamp unit and radiating heat outside the unit.

The foregoing and other objects of the invention can be achieved by a provision of a projection type vehicular headlamp which comprises: a projection unit including a reflector accommodating therein a light source, a tubular lens holder engaged with the front opening of the reflector, and a projection lens supported by the lens holder as one unit, with a clear cut forming shade provided inside the lens holder in such a manner that the shade blocks substantially the lower half of the section of the optical path in the projection unit. In the vehicular headlamp, according to the invention, the shade has an opening in the lower end portion thereof through which spaces fore and rear sides of the shade are communicated with each other.

In the headlamp according to the invention, the air is allowed to flow between the spaces fore and rear sides of the shade through the opening formed therein, thus activating the heat convection in the projection lamp unit, and improving the heat radiation.

DETAILED DESCRIPTION OF THE PREFERRED EMBODIMENT

The preferred embodiment of the present invention will now be described in detail with reference to accompanying drawings.

Figure 1:
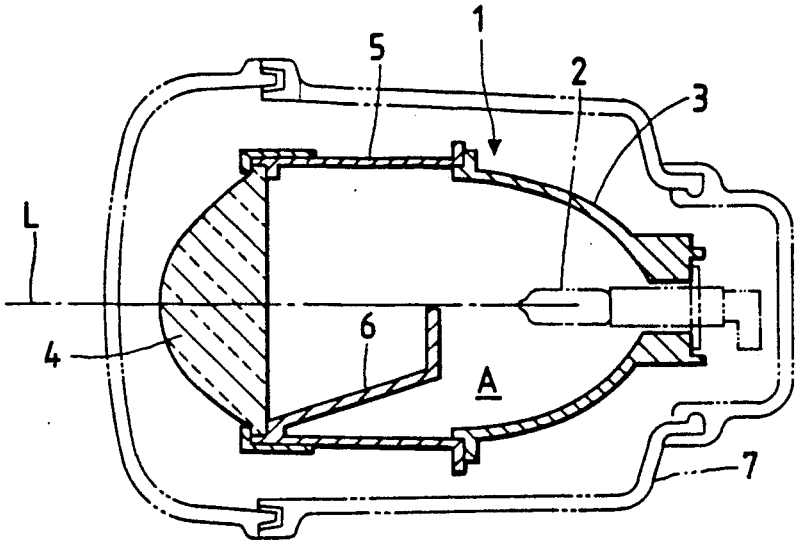
FIG. 1 PRIOR ART
FIG. 1 is a vertical sectional view of a conventional projection type headlamp.
Figure 2:
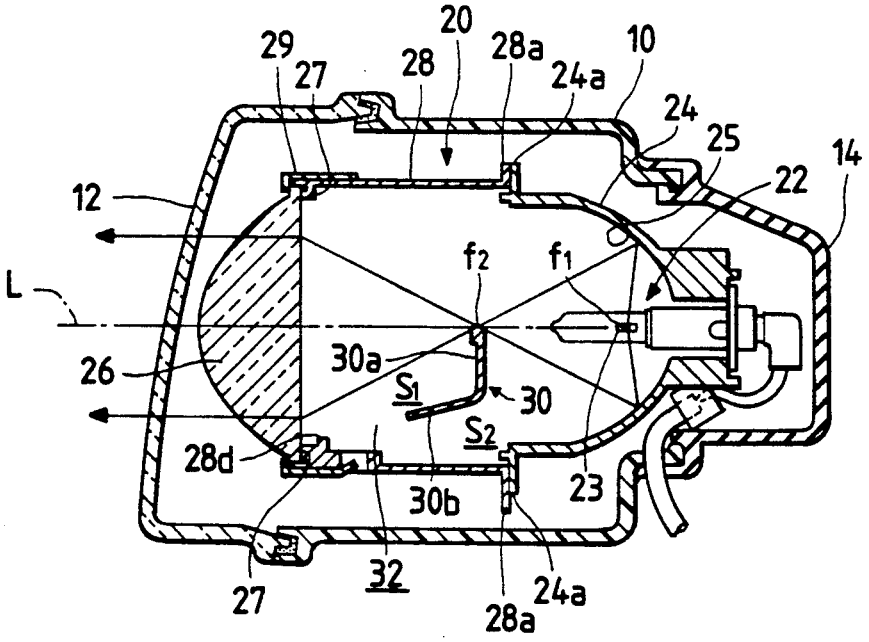
FIG. 2 is a vertical sectional view showing a motor cycle head-lamp which constitutes one embodiment of this invention.
Figure 3:
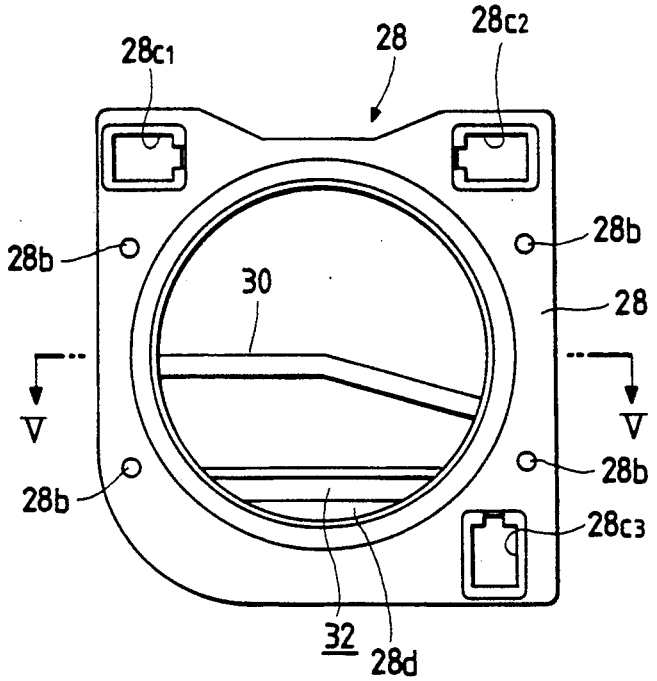
FIG. 3 is a front view of a lens holder shown in FIG. 2.
Figure 4:
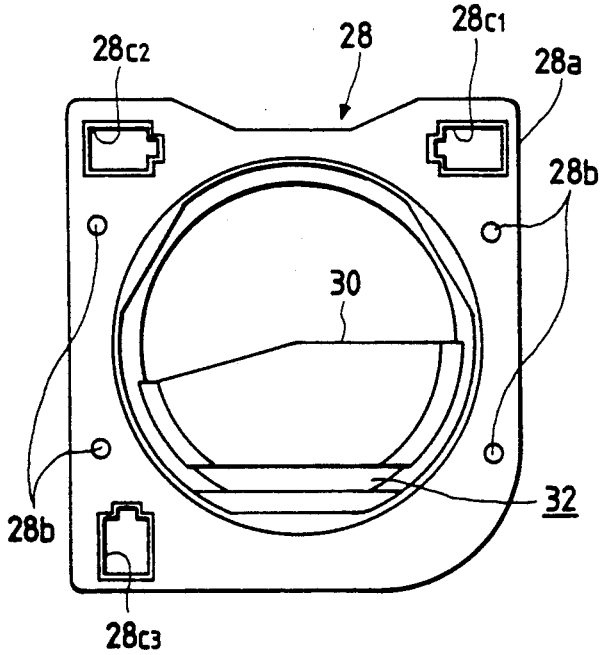
FIG. 4 is a rear view of the lens holder.
Figure 5:
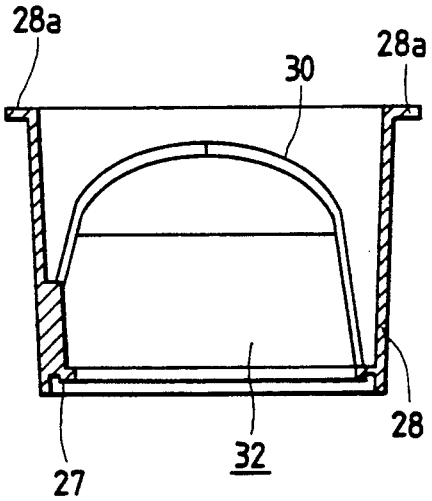
FIG. 5 is a horizontal sectional view taken along line V—V in FIG. 3.

FIG. 2 is a vertical sectional diagram showing a headlamp for a motor cycle which constitutes an embodiment of the invention. FIG. 3 is a front view of a lens holder in the headlamp shown in FIG. 2. FIG. 4 is a rear view of the lens holder. FIG. 5 is a horizontal sectional view taken along line V—V in FIG. 3.

According to the embodiment of the invention, a lamp body 10 houses therein a projection lamp unit 20 supported by an aiming mechanism (not shown). An outer cover 12 is fitted in the front opening of the lamp body 10. The outer cover 12 may be provided with a lens step if necessary. The aiming mechanism supports the projection lamp unit 20 in such a manner that the latter 20 is tiltable with respect to the horizontal axis and the vertical axis of the unit. That is, the irradiation axis (or light axis) L of the light beam can be tilted horizontally and vertically. A back cover 14 formed of rubber is fitted to the rear side opening of the lamp body 10.

The projection unit 20 is provided with a reflector 24 formed of aluminum die cast which is substantially elliptic and accommodates therein a light bulb 22, a tubular lens holder 28 engaged with a front opening of the reflector 24, and a projection lens 26 secured in a front opening of the lens holder 28. A light reflecting surface 25 is formed on the inner surface of the reflector 24 by means of aluminum vacuum deposition. The light bulb 22 is fixedly inserted into a bulb inserting hole from the rear side of the reflector which is formed in the elliptical rear end portion of the reflector 24.

The projection lens 26 is secured with a sealing silicon adhesive to the engaging portion 27 which is formed on the inner surface of the lens holder 28 closed to the front opening. The projection lens 26 is fixedly engaged with the opening with a metal band 29. The lens holder 28 is connected to the reflector 24 in such a manner that a flange **28*a* of the lens holder 28 and a flange 24*a* of the reflector 24 are abutted against each other, and secured by screws. As shown in FIGS. 3 and 4, the screws are inserted into screw inserting holes 28*b* to fixedly engage the lens holder 28 and the reflector 24** together.

A fastener (not shown) with which a horizontally adjusting aiming screw is threadably engaged is inserted in a fastener inserting hole $28c_1$, and a fastener (not shown) with which a vertically adjusting aiming screw is threadably engaged is inserted into a fastener inserting hole $28c_3$. On the other hand, a fastener (not shown) for supporting the lens protruded from the lamp body 10 is inserted in a fastener inserting hole $28c_2$.

A filament 23 of the light bulb 22 is positioned at the first focal point $f_1$ of the light reflecting surface 25. The light beam emitted from the filament 23 is reflected from the light reflecting surface 25. The light beam thus reflected, passing through the second focal point $f_2$ of the light reflecting surface 25, is applied to the projection lens 26 so that it is irradiated in the direction parallel to the optical axis L by the projection lens 26. The upper edge of a clear cut forming shade 30 integrally formed with the lens holder 28 is positioned at the second focal point $f_2$ of the reflecting surface 25 so that a required clear cut is achieved to the light distribution pattern.

The shade 30 is constituted by a shade body 30*a* for forming a required light distribution pattern for a sub beam and a bent portion 30*b* extending from the shade body 30*a* toward the lower portion of the lens 26. The bent portion 30*b* is integrally formed with the lens holder 28 formed of aluminum die cast. An opening 32 is disposed at the lower end portion of the shade 30 so as to communicate the space $S_2$ on the rear side of the shade 30 and the space $S_1$ on the front side of the shade 30 with each other. That is, an air stream is readily formed which flows between the two spaces $S_1$ and $S_2$ through the opening 32, thus allowing the heat convection inside the projection unit 20. Thus, the projection unit according to the invention improves in the heat radiation.

Further, the opening 32 formed on the shade 30 causes to reduce weight of the lens holder as a result the projection lamp unit 20 can be manufactured light in weight.

As shown in FIG. 2, the opening portion of the lens holder 28 is provided with a block wall 28*d* protruding upwardly from the edge of the lower portion thereof, which blocks undesired light beam. If the block wall 28*d* is not provided, then undesired light beam reflected from the inner surface of the lens holder 28 may pass through the opening 32 to the lens 26, thereby adversely affecting the predetermined light distribution pattern. This difficulty is eliminated by the provision of the block wall 28*d*.

While the invention has been described with reference to the motor cycle headlamp, it should be noted that the invention is not limited thereto or thereby. That is, the technical concept of the invention can also be equally applied to motor-drive bicycles and other ordinary automobile headlamps.

As described above, in the projection type vehicular headlamp according to the present invention, the clear cut forming shade is provided with the opening on the lower end portion thereof so that air flows between the spaces fore and rear sides of the shade through the opening, thus allowing the heat convection inside the projection unit. That is, the projection lamp unit is improved in the heat radiation. Hence, the difficulties accompanying a conventional head lamp of this type are eliminated that the heat caught in the projection unit adversely affects the lighting characteristics of the light bulb and the lamp body.

Furthermore, the total weight of the headlamp is reduced as much as the opening is formed on the shade.

What is claimed is:

1. A projection type vehicular headlamp comprising:

a light source;

an elliptic reflector having a front opening and a first and second focal points for reflecting light beam emitted from said light source into an optical path;

a tubular lens holder having a first opening fixedly secured with said front opening of said reflector and a second opening, said tubular lens holder being unbroken between said first and second openings;

a projection lens fitted on said second opening of said lens holder for collimating the light beam reflected by said reflector, said tubular lens holder enclosing a space between said lens and said reflector; and a shade for forming a required cut-off line of projected light beam, said shade being provided inside said lens holder in such a manner that said shade blocks substantially a lower half of the optical path in said projection type headlamp, said shade having an opening formed therein at a lower portion of said shade.

2. The projection type vehicular headlamp of claim 1, wherein said shade comprises a shade body and a bent portion extending from said shade body toward a lower portion of said lens.

3. The projection type vehicular headlamp of claim 2, wherein said bent portion of said shade is unitarily formed with said holder.

4. The projection type vehicular headlamp of claim 1, wherein said light source is a light bulb having a filament positioned at said first focal point of said reflector.

5. The projection type vehicular headlamp of claim 1, wherein said second opening of said lens holder comprises a block wall protruding upwardly from a lower edge portion thereof.

6. The projection type vehicular headlamp of claim 1, wherein said reflector is formed of aluminum die cast.

7. The projection type vehicular headlamp of claim 1, wherein said holder is formed of aluminum die cast.

8. The projection type vehicular headlamp of claim 1, wherein said reflector, said holder and said lens are unitarily formed and constitute a projection lamp unit.

9. The projection type vehicular headlamp of claim 1, further comprising a lamp body, an outer cover fitted on said lamp body at one end thereof and a back cover fixed to said lamp body at the other end thereof, said lamp body, said outer cover and said back cover accommodates therein said reflector, said holder and said lens.

* * * * *